US008499462B2

(12) United States Patent
Masek et al.

(10) Patent No.: US 8,499,462 B2
(45) Date of Patent: Aug. 6, 2013

(54) CUTTING MEMBERS FOR SHAVING RAZORS

(75) Inventors: William Masek, North Attleboro, MA (US); Matthew J. Guay, North Attleboro, MA (US); Michael J. Bond, Duxbury, MA (US); Joseph A. DePuydt, Quincy, MA (US); Ming Laura Xu, Wayland, MA (US)

(73) Assignee: The Gillette Company, Boston, MA (US)

( * ) Notice: Subject to any disclaimer, the term of this patent is extended or adjusted under 35 U.S.C. 154(b) by 1188 days.

(21) Appl. No.: 11/400,989

(22) Filed: Apr. 10, 2006

(65) Prior Publication Data

US 2007/0234576 A1 Oct. 11, 2007

(51) Int. Cl.
*B26B 21/54* (2006.01)

(52) U.S. Cl.
USPC ..... 30/346.54; 30/346.55

(58) Field of Classification Search
USPC ..... 30/50–84; 72/347, 386
See application file for complete search history.

(56) References Cited

U.S. PATENT DOCUMENTS

| | | | | |
|---|---|---|---|---|
| 2,674,039 | A * | 4/1954 | De Mesquita | 30/346.55 |
| 2,705,834 | A | 4/1955 | Lundy | |
| 3,754,329 | A | 8/1973 | Lane | |
| 3,834,017 | A | 9/1974 | Tolmie | |
| 3,834,947 | A | 9/1974 | Swoboda et al. | |
| 3,871,073 | A | 3/1975 | Nissen et al. | |
| 3,911,579 | A | 10/1975 | Lane et al. | |
| 4,167,662 | A | 9/1979 | Steen | |
| 4,287,007 | A * | 9/1981 | Vander Voort | 148/334 |
| 4,302,876 | A | 12/1981 | Emmett | |
| 4,304,978 | A | 12/1981 | Saunders | |
| 4,473,735 | A | 9/1984 | Steffen | |
| 4,507,538 | A | 3/1985 | Brown et al. | |
| 4,603,477 | A * | 8/1986 | Francis | 30/50 |
| 4,621,424 | A * | 11/1986 | Jacobson | 30/41 |
| 4,980,021 | A | 12/1990 | Kitamura et al. | |
| 4,998,347 | A | 3/1991 | Schachter | |
| 5,010,646 | A * | 4/1991 | Neamtu | 30/50 |
| 5,224,267 | A | 7/1993 | Simms | |
| 5,347,887 | A | 9/1994 | Rosenthal et al. | |
| 5,360,495 | A | 11/1994 | Schuler et al. | |

(Continued)

FOREIGN PATENT DOCUMENTS

| | | |
|---|---|---|
| EP | 0 191 203 A2 | 8/1988 |
| EP | 0 640 693 A1 | 1/1995 |

(Continued)

OTHER PUBLICATIONS

Report No. 3709/10024, O. D. Oglesby, 'Extending Hairs With Controlled Forces', 15 Pages, 8 Figures, 1 Table, 6 Plates, date unknown.

(Continued)

*Primary Examiner* — Robert Scruggs
(74) *Attorney, Agent, or Firm* — Kevin C. Johnson; Steven W. Miller

(57) ABSTRACT

A cutting member for a shaving razor includes an elongated blade portion that tapers to a cutting edge, an elongated base portion that is integral with the blade portion, and a bent portion, intermediate the blade portion and the base portion. In some implementations, at least part of the cutting member has a thickness of at least about 0.005 inch (0.127 millimeter).

15 Claims, 6 Drawing Sheets

U.S. PATENT DOCUMENTS

| | | | | |
|---|---|---|---|---|
| 5,488,774 | A | 2/1996 | Janowski | |
| 5,522,137 | A | 6/1996 | Andrews | |
| 5,528,834 | A * | 6/1996 | Seber et al. | 30/340 |
| 5,532,495 | A | 7/1996 | Bloomquist et al. | |
| 5,546,660 | A | 8/1996 | Burout et al. | |
| 5,575,185 | A | 11/1996 | Cox et al. | |
| 5,630,275 | A | 5/1997 | Wexler | |
| 5,778,722 | A * | 7/1998 | Saiki et al. | 72/347 |
| 5,906,053 | A | 5/1999 | Turner et al. | |
| 6,055,731 | A | 5/2000 | Zucker | |
| 6,077,572 | A | 6/2000 | Hopwood et al. | |
| 6,082,007 | A | 7/2000 | Andrews | |
| 6,156,435 | A | 12/2000 | Gleason et al. | |
| 6,161,287 | A | 12/2000 | Swanson et al. | |
| 6,161,288 | A | 12/2000 | Andrews | |
| 6,178,852 | B1 | 1/2001 | Pfaff | |
| 6,205,831 | B1 * | 3/2001 | Adey et al. | 72/47 |
| 6,243,951 | B1 | 6/2001 | Oldroyed | |
| 6,289,593 | B1 | 9/2001 | Decker et al. | |
| 6,295,734 | B1 | 10/2001 | Gilder et al. | |
| 6,330,750 | B1 * | 12/2001 | Meckel | 30/350 |
| 6,335,506 | B2 | 1/2002 | Christmas et al. | |
| 6,353,204 | B1 | 3/2002 | Spaay et al. | |
| 6,442,840 | B2 | 9/2002 | Zuker | |
| 6,468,642 | B1 | 10/2002 | Bray et al. | |
| 6,511,559 | B2 | 1/2003 | Brenner et al. | |
| 6,534,131 | B1 | 3/2003 | Domoto et al. | |
| 6,612,204 | B1 | 9/2003 | Droese et al. | |
| 2001/0013174 | A1 | 8/2001 | Zucker | |
| 2001/0015348 | A1 | 8/2001 | Christmas et al. | |
| 2002/0066186 | A1 | 6/2002 | White et al. | |
| 2002/0100522 | A1 | 8/2002 | Benton et al. | |
| 2003/0204954 | A1 * | 11/2003 | Wain | 30/49 |
| 2004/0187644 | A1 | 9/2004 | Peterlin et al. | |
| 2005/0172489 | A1 | 8/2005 | Aviza | |
| 2005/0198828 | A1 | 9/2005 | Pennella | |
| 2007/0124939 | A1 * | 6/2007 | Van Eibergen Santhagens | 30/50 |

FOREIGN PATENT DOCUMENTS

| | | | |
|---|---|---|---|
| EP | 0 850 126 | B1 | 1/2001 |
| GB | 2055069 | A | 2/1981 |
| JP | 60-165319 | | 8/1985 |
| JP | 60165319 | A | 8/1985 |
| JP | 60-258416 | | 12/1985 |
| JP | 60258416 | A | 12/1985 |
| JP | 04263020 | A | 9/1992 |
| WO | WO 95/04637 | A1 | 2/1995 |
| WO | WO 2004/112986 | A1 | 12/2004 |

OTHER PUBLICATIONS

Report No. 3677/10024, O. D. Oglesby, 'Beard Hair Response to Applied Forces', 27 Pages, 11 Figures, 3 Tables, 3 Plates, dated Apr. 12, 1995.

PCT International Search Report dated Sep. 12, 2007.

* cited by examiner

CUTTING MEMBERS FOR SHAVING RAZORS

TECHNICAL FIELD

This invention relates to cutting members for shaving razors.

BACKGROUND

Razor blades are typically formed of a suitable metallic sheet material such as stainless steel, which is slit to a desired width and heat-treated to harden the metal. The hardening operation utilizes a high temperature furnace, where the metal may be exposed to temperatures greater than 1145° C. for up to 18 seconds, followed by quenching.

After hardening, a cutting edge is formed on the blade. The cutting edge typically has a wedge-shaped configuration with an ultimate tip having a radius less than about 1000 angstroms, e.g., about 200-300 angstroms.

The razor blades are generally mounted on bent metal supports and attached to a shaving razor (e.g., a cartridge for a shaving razor). FIG. 1, for example, illustrates a prior art razor blade assembly that includes a planar blade 10 attached (e.g., welded) to a bent metal support 11. Blade 10 includes a tapered region 14 that terminates in a cutting edge 15 16. This type of assembly is secured to shaving razors (e.g., to cartridges for shaving razors) to enable users to cut hair (e.g., facial hair) with cutting edge 16. Bent metal support 11 provides the relatively delicate blade 10 with sufficient support to withstand forces applied to blade 10 during the shaving process. Examples of razor cartridges having supported blades are shown in U.S. Pat. No. 4,378,634 and in U.S. patent application Ser. No. 10/798,525, filed Mar. 11, 2004, which are incorporated by reference herein.

SUMMARY

In some aspects, the invention features a cutting member for a shaving razor, the cutting member including an elongated blade portion that tapers to a cutting edge; an elongated base portion that is integral with the blade portion; and a bent portion, intermediate the blade portion and the base portion.

In one such aspect, at least part of the cutting member has a thickness of at least about 0.005 inch (0.127 millimeter).

In another such aspect, the cutting member is formed of a material about 0.35 to about 0.43 percent carbon, about 0.90 to about 1.35 percent molybdenum, about 0.40 to about 0.90 percent manganese, about 13 to about 14 percent chromium, no more than about 0.030 percent phosphorus, about 0.20 to about 0.55 percent silicon, and no more than about 0.025 percent sulfur.

In yet another of these aspects, at least part of the cutting member has a ductility of at least about seven percent elongation.

Some embodiments include one or more of the following features. The cutting member may have an average thickness of about 0.005 inch (0.127 millimeter) to about 0.01 inch (0.254 millimeter); in some cases substantially the entire elongated blade, except for the cutting edge, has a thickness in this range. The bent portion may have an average thickness that is at least about 5 percent less than an average thickness of the base portion. The elongated base portion may be configured to be secured to the shaving razor. The elongated blade portion may extend at an angle of about 108 degrees to about 115 degrees relative to the elongated base portion.

The invention also features a cutting member for a shaving razor, the cutting member including a first portion; a second portion; and a bent portion intermediate the first and second portions, the bent portion having a thickness that is at least about five percent less than an average thickness of the cutting member.

The invention also features methods of making cutting members and razors including such members.

In one aspect, the invention features a method including deforming a continuous strip of material, and then separating the continuous strip into multiple discrete blades, each blade having a first portion, a second portion, and a bent portion intermediate the first and second portions.

Some embodiments may include one or more of the following features. Deforming the continuous strip of material may include pressing the strip of material between a punch and a die. Separating the continuous strip may include stamping or punching the strip. The method may also include punching longitudinally spaced apart slots in the strip prior to deforming the strip, the slots at least partially separating regions of the strip corresponding to the blades.

In another aspect, the invention features a method including hardening a strip of blade steel; forming a cutting edge on the hardened strip; after forming the cutting edge, bending the strip along its length by coining the strip; and separating the bent strip into individual blades, each blade having a bent portion.

Some embodiments may include one or more of the following features. The strip may be bent using a forming die that is configured so as not to touch the cutting edge. Bending the strip may reduce the thickness of the blade steel in the bent portion by at least about five percent relative to an original thickness of the blade steel.

The invention also features razors and razor cartridges including the cutting members described herein.

Embodiments can include one or more of the following advantages.

In some embodiments, the cutting member can be affixed to a cartridge of the shaving razor without the use of bent supports. Consequently, the shaving razor can include fewer components and, therefore, can be more cost-efficient than many conventional shaving razors.

In certain embodiments, the cutting member has a thickness that provides sufficient rigidity to prevent substantial deformation of the cutting member during use of the shaving razor.

In some embodiments, the cutting member is formed of a blade steel that has a hardness sufficient for forming a cutting edge that can cut hair, and has a ductility that is sufficient to allow bending of the blade without fracture or other substantial defects.

In some embodiments, the cutting members can be formed using a substantially continuous manufacturing process.

Other features and advantages of the invention can be found in the description, the drawings, and the claims.

DETAILED DESCRIPTION

Figure 2A:
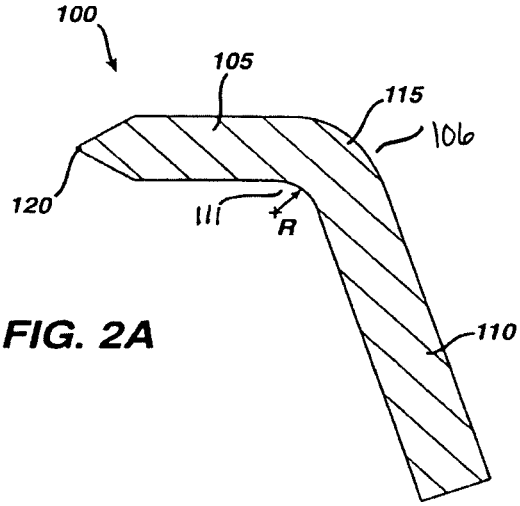
FIG. 2A is a cross-sectional view of an embodiment of a bent cutting member for a shaving razor.

Referring to FIG. 2A, a cutting member 100 includes a blade portion 105, a base portion 110, and a bent portion 115 that interconnects blade and base portions 105, 110. Blade portion 105 terminates in a relatively sharp cutting edge 120, while base portion 110 terminates in a relatively blunt end region.

Figure 3:
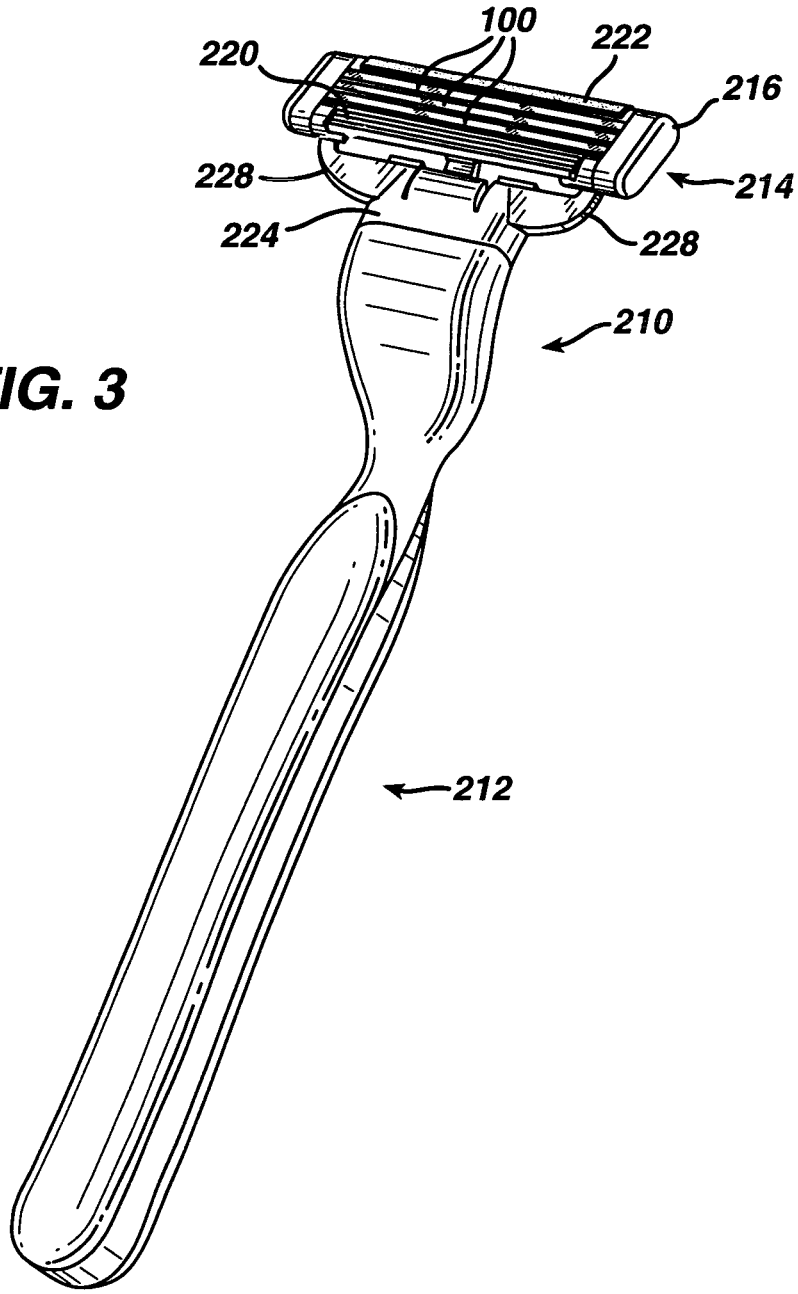
FIG. 3 illustrates a shaving razor that includes the bent cutting member of FIG. 2A.

As shown in FIG. 3, cutting member 100 can be used in shaving razor 210, which includes a handle 212 and a replaceable shaving cartridge 214. Cartridge 214 includes housing 216, which carries three cutting members 100, a guard 220, and a cap 222. In other embodiments, the cartridge may include fewer or more blades.

Figure 1:
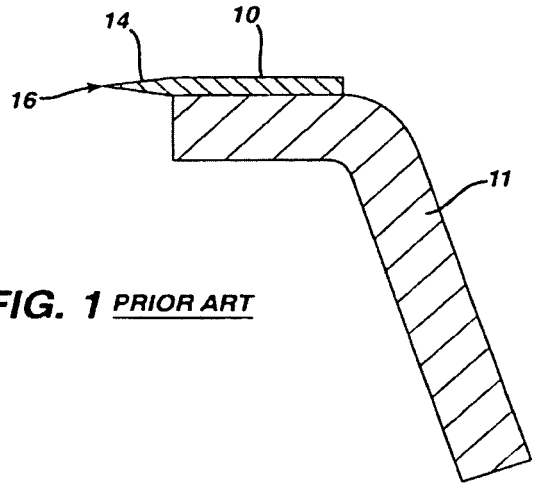
FIG. 1 PRIOR ART
FIG. 1 is a cross-sectional view of a prior art razor blade assembly including a planar cutting member attached to a bent support.
Figure 2B:
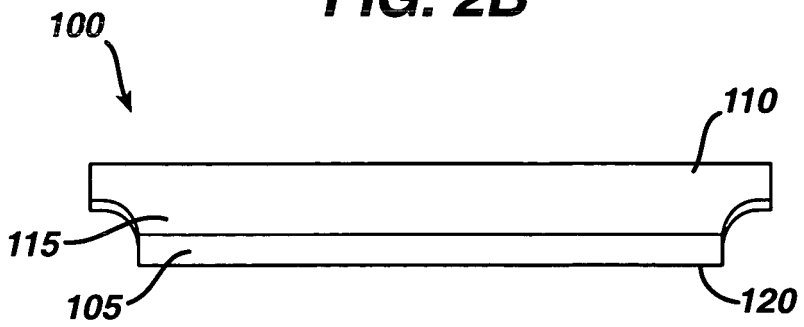
FIG. 2B is a top view of the cutting member of FIG. 2A.

Cutting members 100 can be mounted within cartridge 214 without the use of additional supports (e.g., without the use of bent metal supports like the one shown in FIG. 1). Cutting members 100 are captured at their ends and by a spring support under the blade portion 105. The cutting members are allowed to move, during shaving, in a direction generally perpendicular to the length of blade portion 105. As shown in FIGS. 2A and 2B, the lower base portions 110 of cutting members 100 extend to the sides beyond the upper bent and blade portions 115, 105. The lower base portions 110 can be arranged to slide up and down within slots in cartridge housing 216 while the upper portion rests against resilient arms during shaving. The slots of the cartridge housing 216 have back stop portions and front stop portions that define, between them, a region in which cutting members 100 can move forward and backward as they slide up and down in the slots during shaving. The front stop portions are generally positioned beyond the ends of blade portions 105, so as not to interfere with movement of blade portions 105. Cutting members 100 are arranged within cartridge 214 such that cutting edges 220 are exposed. Cartridge 214 also includes an interconnect member 224 on which housing 216 is pivotally mounted at two arms 228. When cartridge 214 is attached to handle 212 (e.g., by connecting interconnect member 224 to handle 212), as shown in FIG. 3, a user can move the relatively flat face of cartridge 214 across his/her skin in a manner that permits cutting edges 120 of cutting members 100 to cut hairs extending from the user's skin.

Figure 2C:
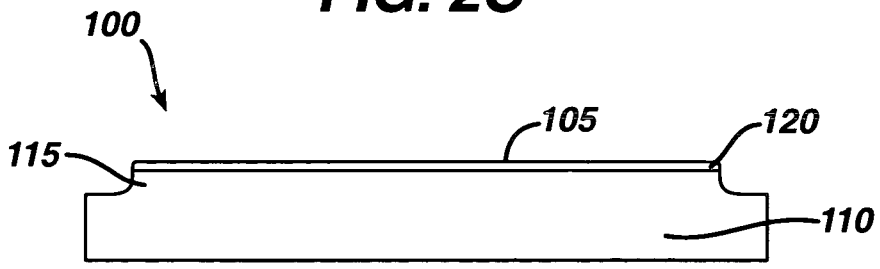
FIG. 2C is a front view of the cutting member of FIG. 2A.

Referring again to FIG. 2, blade portion 105 of cutting member 100 has a length of about 0.032 inch (0.82 millimeters) to about 0.059 inch (1.49 millimeters). Base portion 110 has a length of about 0.087 inch (2.22 millimeters) to about 0.093 inch (2.36 millimeters). Bent portion 115 has a bend radius R of about 0.020 inch (0.45 millimeter) or less (e.g., about 0.012 inch (0.30 millimeter)). Relative to base portion 110, blade portion 105 extends at an angle of about 115 degrees or less (e.g., about 108 degrees to about 115 degrees, about 110 to about 113 degrees). Cutting edge 120 of blade portion 105 has a wedge-shaped configuration with an ultimate tip having a radius less than about 1000 angstroms (e.g., from about 200 to about 300 angstroms).

In certain embodiments, cutting member 100 is relatively thick, as compared to many conventional razor blades. Cutting member 100, for example, can have an average thickness of at least about 0.003 inch (0.076 millimeter), e.g., about 0.005 inch (0.127 millimeter) to about 0.01 inch (0.254 millimeter). As a result of its relatively thick structure, cutting member 100 can provide increased rigidity, which can improve the comfort of the user and/or the cutting performance of cutting member 100 during use. In some embodiments, cutting member 100 has a substantially constant thickness. For example, blade portion 105 (except for cutting edge 120), base portion 110, and bent portion 115 can have substantially the same thickness.

In some embodiments, the thickness of bent portion 115 is less than the thickness of blade portion 105 and/or base portion 110. For example, the thickness of bent portion 115 can be less than the thickness of blade portion 105 and/or base portion 110 by at least about five percent (e.g., about five percent to about 30 percent, about ten percent to about 20 percent).

In certain embodiments, cutting member 100 (e.g., base portion 110 of cutting member 100) has a hardness of about 540 HV to about 750 HV (e.g., about 540 HV to about 620 HV). Bent portion 115 can, for example, have a hardness of about 540 HV to about 620 HV. The hardness of cutting member 100 can be measured by ASTM E92-82—Standard Test Method for Vickers Hardness of Metallic Materials.

In some embodiments, cutting member 100 (e.g., bent portion 115 of cutting member 100) has a ductility of about seven percent to about 12 percent (e.g., about nine percent to about ten percent) elongation measured in uniaxial tension at fracture. The ductility of bent portion 115 can be measured, for example, by ASTM E345-93—Standard Test Methods of Tension Testing of Metallic Foil.

In some embodiments, bent portion 115 and the remainder of cutting member 100 have substantially the same ductility.

Cutting member 100 can be formed of any of various suitable materials. In certain embodiments, cutting member 100 is formed of a material having a composition comprised of about 0.35 to about 0.43 percent carbon, about 0.90 to about 1.35 percent molybdenum, about 0.40 to about 0.90 percent manganese, about 13 to about 14 percent chromium, no more than about 0.030 percent phosphorus, about 0.20 to about 0.55 percent silicon, and no more than about 0.025 percent sulfur. Cutting member 100 can, for example, be formed of a stainless steel having a carbon content of about 0.4 percent by weight, a chromium content of about 13 percent by weight, a molybdenum content of about 1.25 percent by weight, and amounts of manganese, chromium, phosphorus, silicon and sulfur within the above ranges.

In some embodiments, blade portion 105 and/or base portion 110 have minimal levels of bow 106 and sweep 111. Bow is a term used to describe an arching normal to the plane in which the portion of the cutting member is intended to lie. Sweep, also commonly referred to as camber, is a term used to describe an arching within the plane in which the portion of the cutting member lies (e.g., an arching of the longitudinal edges of the portion of the cutting member). In some embodiments, blade portion 105 has a bow of about +0.0004 to about −0.002 inch (+0.01 to −0.05 millimeter) or less across the length of the blade portion. In certain embodiments, blade portion 105 has a sweep of about ±0.0027 inch (±0.07 millimeter) or less across the length of the blade portion. Base portion 110 can have a bow of about ±0.0024 inch (±0.060 millimeter) or less across the length of the base portion. By reducing the levels of bow and/or sweep in blade portion 105 and/or base portion 110, the comfort of the user and/or the cutting performance of cutting member 100 can be improved.

Figure 4:
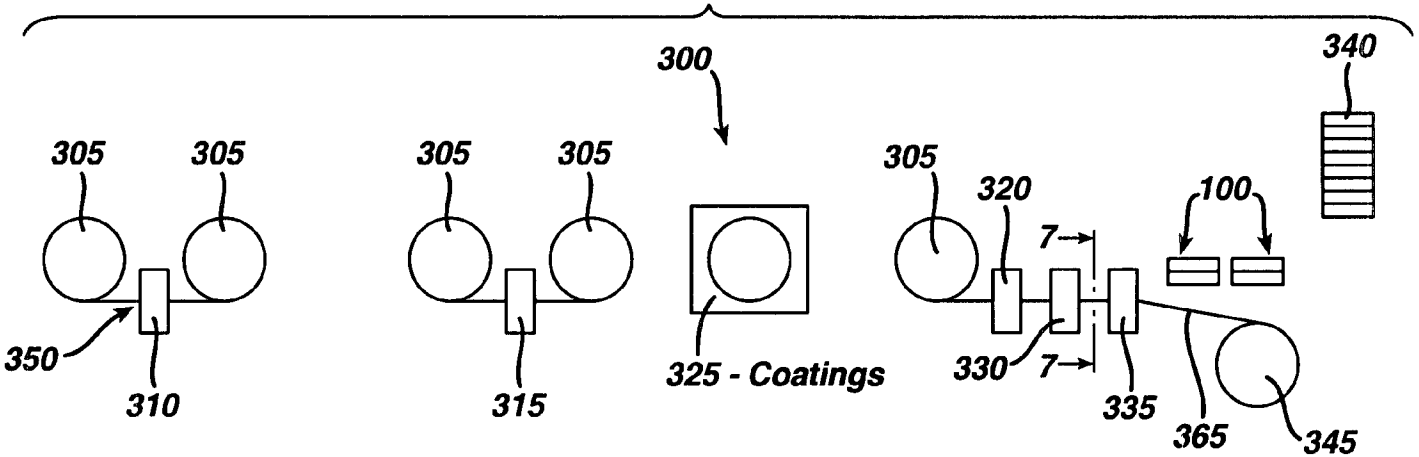
FIG. 4 illustrates a method and apparatus for forming the cutting member of FIG. 2A.
Figure 5:
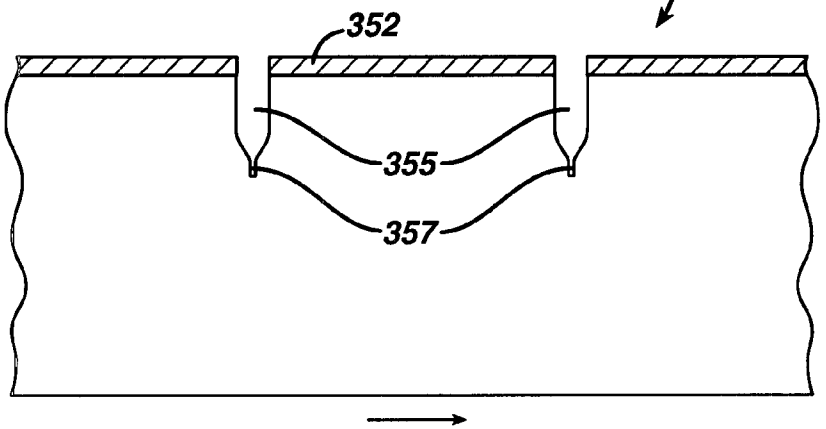
FIG. 5 is a partial top view of a strip of blade steel after exiting a cutting device of the apparatus shown in FIG. 4.
Figure 6:
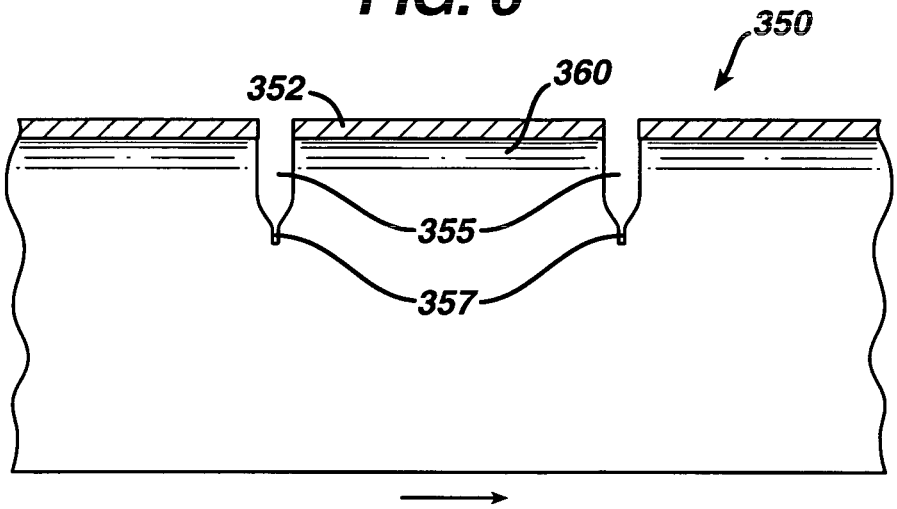
FIG. 6 is a partial top view of the strip of blade steel after exiting a bending device of the apparatus shown in FIG. 4.
Figure 7:
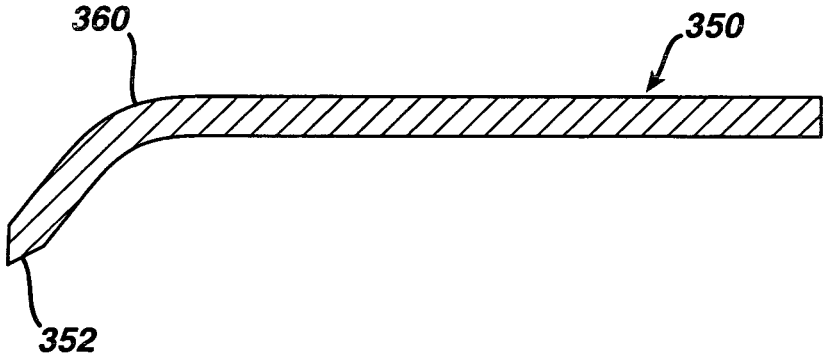
FIG. 7 is a cross-sectional view of the strip of blade steel taken along line 7-7 in FIG. 4.

FIG. 4 shows a method and apparatus 300 for forming cutting members 100. A continuous strip of blade steel 350 is conveyed (e.g., pulled by a rotating roll from a roll 305 of blade steel to a heat-treating device 310, where strip 350 is heat-treated to increase the hardness of the blade steel. Strip 350 is then re-coiled into a roll 305 of hardened blade steel, and subsequently unwound and conveyed to a sharpening device 315, where the hardened edge region of the strip is sharpened to form a cutting edge 352. Strip 350 is again re-coiled into a roll 305 of hardened and sharpened blade steel, after which it is coated with hard and lubricious coatings using a coating device 325. Strip 350 is then unwound and conveyed to a cutting/stamping station which includes a cutting device 320. Cutting device 320 creates transverse slots 355 and adjoining slits 357 (FIG. 5) across longitudinally spaced apart regions of strip 350 (as shown in FIG. 5). Strip 350 is then conveyed to a bending device 330, within the cutting/stamping station, that creates a longitudinal bend 360 in the regions of strip 350 between transverse slots 355 (shown in FIGS. 6 and 7). After being bent, strip 350 is separated into multiple, discrete cutting members 100 by a separating device 335, also within the cutting/stamping station. Cutting members 100 may then be arranged in a stack 340 for transport and/or for further processing, or assembled directly into cartridges, and a scrap region 365 of strip 350 is assembled onto roll 345 for recycling or disposal. Scrap region 365, for example, can be used merely to help convey strip 350 through the blade forming devices described above. Alternatively or additionally, any of various other techniques can be used to convey strip 350 through the blade forming devices.

Sharpening device 315 can be any device capable of sharpening the edge of strip 350. Examples of razor blade cutting edge structures and processes of manufacture are described in U.S. Pat. Nos. 5,295,305; 5,232,568; 4,933,058; 5,032,243; 5,497,550; 5,940,975; 5,669,144; EP 0591334; and PCT 92/03330, which are hereby incorporated by reference.

Cutting device 320 can be any of various devices capable of providing slots 355 and/or slits 357 in strip 350. In some embodiments, cutting device is a punch press. In such embodiments, the progression of strip 350 can be periodically paused in order to allow the punch press to stamp slots 355 and/or slits 357 in strip 350. Cutting device 320 can alternatively or additionally be any of various other devices, such as a high power laser or a scoring operation followed by a bending or fracturing operation.

Referring again to FIG. 5, after strip 350 has been conveyed through cutting device 320, strip 350 includes multiple, longitudinally spaced apart slots 355 and that extend inwardly from the sharpened edge of the strip to a central region of the strip. Slits 357 extend inwardly from slots 355. Slots 355 are spaced apart by a distance that corresponds to the width of cutting members 100. In some embodiments, adjacent slots 355 are spaced apart from one another by about 36.20 millimeters to about 36.50 millimeters. In certain embodiments, adjacent slits are spaced apart from one another by about 37.26 millimeters to about 37.36 millimeters. By providing discrete regions that are separated by slots 355, the bending of strip 350 can be improved.

Figure 8A:
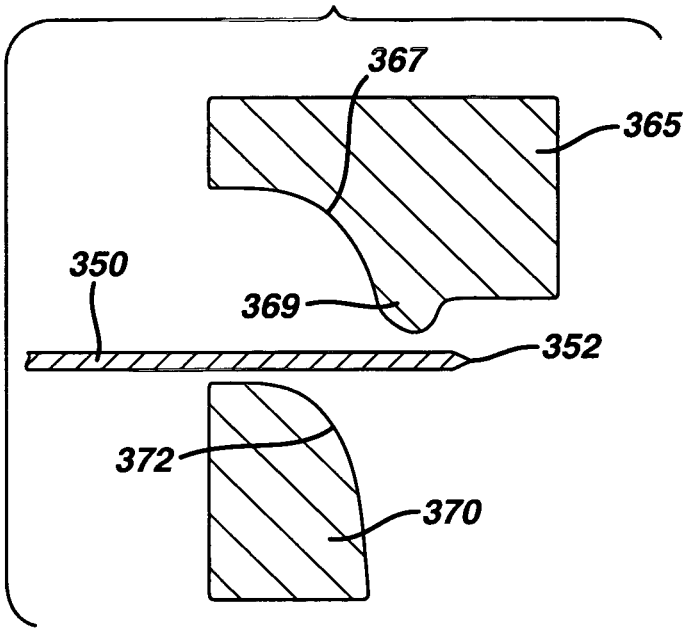
FIGS. 8A and 8B illustrate an embodiment of a method of forming a bent region in the strip of blade steel.
Figure 8B:
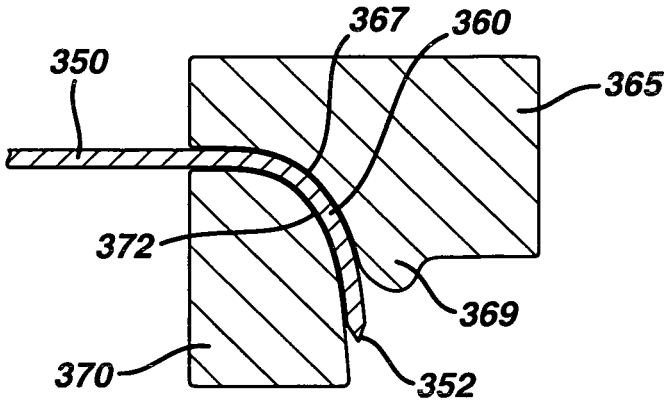

Bending device 330 can be any device capable of forming a longitudinal bend in strip 350. In some embodiments, as shown in FIGS. 8A and 8B, bending device 330 is an assembly that includes a punch 365 and a die 370. Punch 365 includes a curved portion 367 that is configured to mate with an associated curved portion 372 of die 370. Generally, curved portion 367 of punch 365 has a radius that is slightly larger than a radius of curved portion 372 of die 370. Curved portion 367 of punch 365, for example can have a radius of about 0.0231" to about 0.0241", while curved portion 372 of die 370 can have a radius of about 0.010" to about 0.014". Punch 365 also includes a protrusion 369 that is configured to contact a portion of strip 350 that, as discussed below, is offset from sharpened edge 352 of strip 350.

To form bent region 360 of strip 350, the relatively planar strip 350 is positioned between punch 365 and die 370, as shown in FIG. 8A. Punch 365 and die 370 are then moved toward one another such that curved portions 367 and 372 generally mate. Punch 365 can, for example, be moved toward die 370 at a rate of about 25 ft/min (10 m/min) to about 500 ft/min (200 m/min). As punch 365 and die 370 are moved toward one another, protrusion 369 of punch 365 contacts a region of strip 350 offset from sharpened edge 352. As punch 365 and die 370 mate with one another, strip 350 is deformed into a bent position between punch 365 and die 370. Due to the configuration of punch 365 and die 367, sharpened edge 352 can remain untouched throughout the bending process. This to arrangement can help to prevent damage to the relatively delicate, sharpened edge 352 of strip 350.

As a result of the bending process, the thickness of strip 350 in bent region 360 can be reduced, relative to the thickness of strip 350 prior to being bent, by at least about five percent (e.g., about five percent to about 30 percent). Strip 350 in bent region 360, for example, can have a thickness of about 0.0035 inch (0.089 millimeter) to about 0.0095 inch (0.241 millimeter), while the remainder of strip 350 can have a thickness of about 0.005 inch (0.127 millimeter) to about 0.01 inch (0.254 millimeter).

Separating device 335 can be any device capable of separating the regions of strip 350 between slots 355 from the remainder of strip 350 to form discrete cutting members 100. In some embodiments, separating device 335 is a punch press. The progression of strip 350 can be periodically paused to allow the punch press to accurately separate the regions of strip 350 between slots 355 from the remainder of strip 350 to form cutting members 100.

Other devices capable of separating the regions of strip 350 between slots 355 from the remainder of strip 350 can alternatively or additionally be used. Examples of such devices include a high power laser or a scoring operation followed by a bending or fracturing operation.

While certain embodiments have been described, other embodiments are possible.

As an example, the order of many of the process steps discussed above can be altered. The process steps can be ordered in any of various different combinations.

Other embodiments are within the scope of the claims.

What is claimed is:

1. A cutting member for a shaving razor, the cutting member comprising; an elongated blade portion that tapers to a cutting edge, the elongated blade portion being formed from a blade strip having slits with adjoining slots that extend inwardly from the cutting edge wherein the slots are spaced apart by a distance that corresponds to a width of the elongated blade portion; an elongated base portion that is integral with the blade portion; a bent portion, intermediate the blade portion and the base portion, and wherein at least part of the cutting member has a thickness of at least about 0.005 inch (0.127 millimeter) and wherein the bent portion has an average thickness that is at least about 5 percent less than an average thickness of the base portion.

2. The cutting member of claim 1, wherein the cutting member has an average thickness of about 0.005 inch (0.127 millimeter) to about 0.01 inch (0.254 millimeter).

3. The cutting member of claim 2, wherein substantially the entire elongated blade, except for the cutting edge, has a thickness of 0.005 inch (0.127 millimeter) to about 0.01 inch (0.254 millimeter).

4. The cutting member of claim 1, wherein the base portion has a hardness of about 540 HV to about 750 HV.

5. The cutting member of claim 1, wherein the elongated base portion is configured to be secured to the shaving razor.

6. The cutting member of claim 1, wherein the elongated blade portion and the elongated base portion are substantially planar.

7. The cutting member of claim 6, wherein the elongated blade portion extends at an angle of about 108 degrees to about 115 degrees relative to the elongated base portion.

8. The cutting member of claim 1, wherein the elongated blade portion has a bow of about +0.010 to −0.050 millimeters or less across the length of the blade portion.

9. The cutting member of claim 1, wherein the elongated blade portion has a sweep of about +0.070 millimeters or less across the length of the blade portion.

10. The cutting member of claim 1, wherein the bent portion has a bend radius of about 0.020 inch (0.45 millimeter) or less.

11. The cutting member of claim 1, wherein the cutting member is formed of a metal comprising about 0.35 to about 0.43 percent carbon, about 0.90 to about 1.35 percent molybdenum, about 0.40 to about 0.90 percent manganese, about 13 to about 14 percent chromium, no more than about 0.030 percent phosphorus, about 0.20 to about 0.55 percent silicon, and no more than about 0.025 percent sulfur.

12. The cutting member of claim 1, wherein the bent portion has a ductility of about seven percent to about 12 percent elongation.

13. The cutting member of claim 1, wherein the slits are spaced apart by a distance that is greater than the distance of the spaced apart slots.

14. The cutting member of claim 13 wherein the distance of the spaced apart slits is about 37.26 mm to about 37.36 mm.

15. The cutting member of claim 1 wherein the distance of the spaced apart slots is about 36.20 mm to about 36.50 mm.

* * * * *